US007142796B2

(12) United States Patent
Hymas et al.

(10) Patent No.: US 7,142,796 B2
(45) Date of Patent: Nov. 28, 2006

(54) SPACER FOR PRINT CARTRIDGE

(75) Inventors: Scott K Hymas, Meridian, ID (US); Kenneth Line, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/013,599

(22) Filed: Dec. 15, 2004

(65) Prior Publication Data

US 2006/0072937 A1 Apr. 6, 2006

Related U.S. Application Data

(60) Provisional application No. 60/616,776, filed on Oct. 6, 2004.

(51) Int. Cl.
*G03G 15/00* (2006.01)
*G03G 21/18* (2006.01)

(52) U.S. Cl. ..... 399/111; 399/107

(58) Field of Classification Search ..... 399/303, 399/279, 265, 111, 113, 110, 107
See application file for complete search history.

(56) References Cited

U.S. PATENT DOCUMENTS

| | | | | |
|---|---|---|---|---|
| 4,583,832 | A * | 4/1986 | Kasamura et al. | 399/119 |
| 4,827,305 | A * | 5/1989 | Enoguchi et al. | 399/119 |
| 5,060,016 | A * | 10/1991 | Wanou et al. | 399/175 |
| 6,240,268 | B1 * | 5/2001 | Nishiuwatoko | 399/119 |
| 6,665,507 | B1 * | 12/2003 | Hooper et al. | 399/110 |
| 6,681,089 | B1 * | 1/2004 | Dougherty | 399/111 |
| 6,907,216 | B1 * | 6/2005 | Nishimura | 399/282 |

* cited by examiner

*Primary Examiner*—Sophia S. Chen

(57) ABSTRACT

In one embodiment, an article includes a spacer configured to increase a dimension of only a portion of a guide part on a print cartridge when the spacer is fastened to the guide part and a fastener allowing the spacer to be removably fastened to the guide part.

13 Claims, 7 Drawing Sheets

SPACER FOR PRINT CARTRIDGE

CLAIM OF PRIORITY

This application claims the benefit of U.S. Provisional Application No. 60/616,776, filed on Oct. 6, 2004, and titled SPACER FOR PRINT CARTRIDGE.

BACKGROUND

Printers, copiers and facsimile machines use modular print components. For example, many laser printers use a replaceable print cartridge that houses the toner reservoir, the photoconductor drum assembly, and the charge and developer roller assemblies. It is advantageous to package a new printer for storage and shipping with the print cartridge installed in the printer. Two problems should be addressed when considering packaging a printer with the print cartridge installed. First, the so-called "rub memory" in which the charge characteristics of the photoconductor drum is changed by the transfer roller rubbing against the photoconductor drum during handling of the packaged printer. Second, the softer transfer roller can be permanently deformed when pressed against the photoconductor drum in one position for the comparatively long period a new printer may remain packaged. Both of these problems are eliminated if the photoconductor drum and the transfer roller are separated in the printer package.

DRAWINGS

Figure 3:
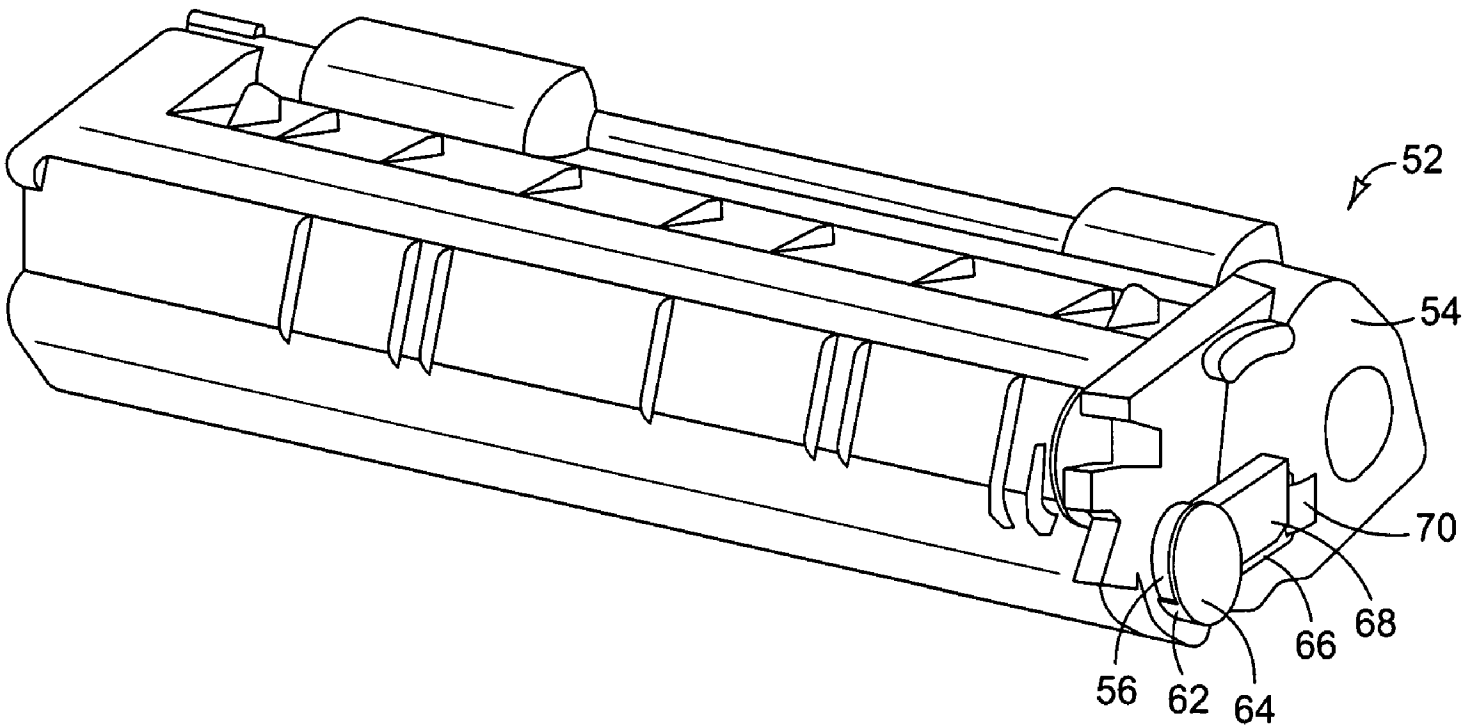
FIGS. 3 and 4 are perspective views of a print cartridge such as might be used in the printer of FIG. 2 with packaging spacers according to one embodiment of the invention.
Figure 4:
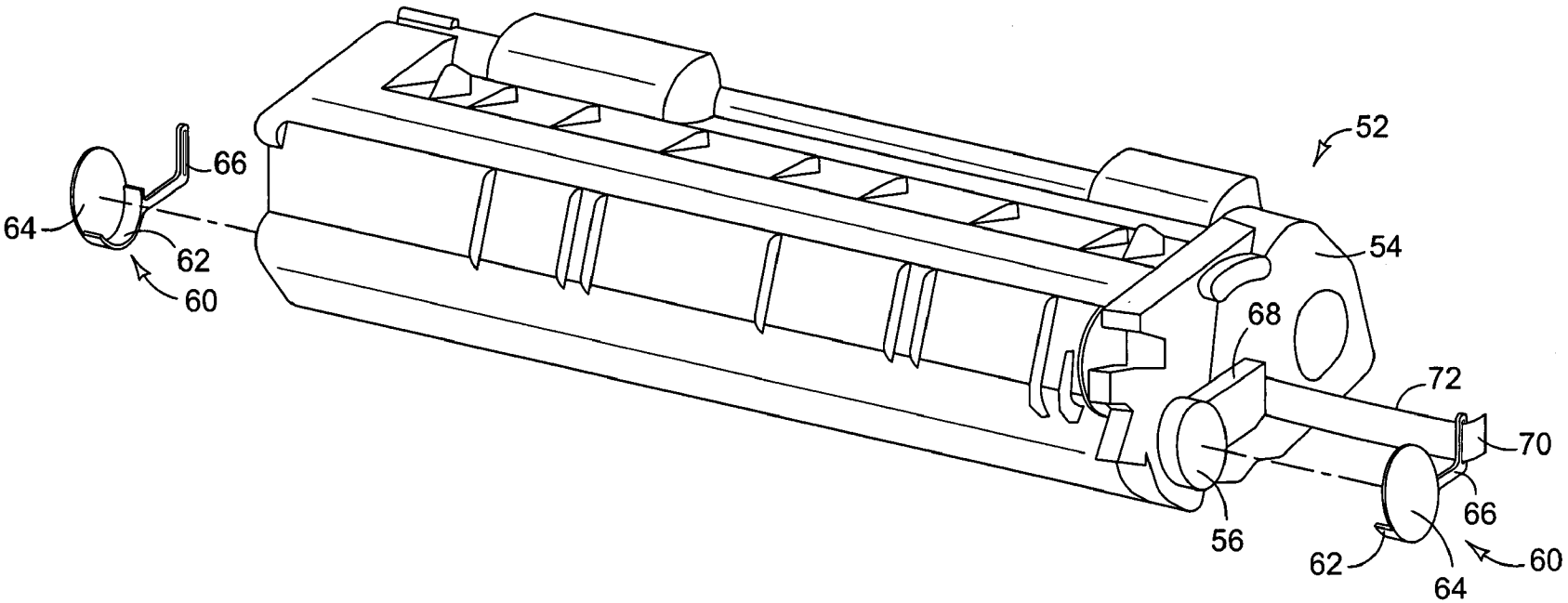
Figure 5:
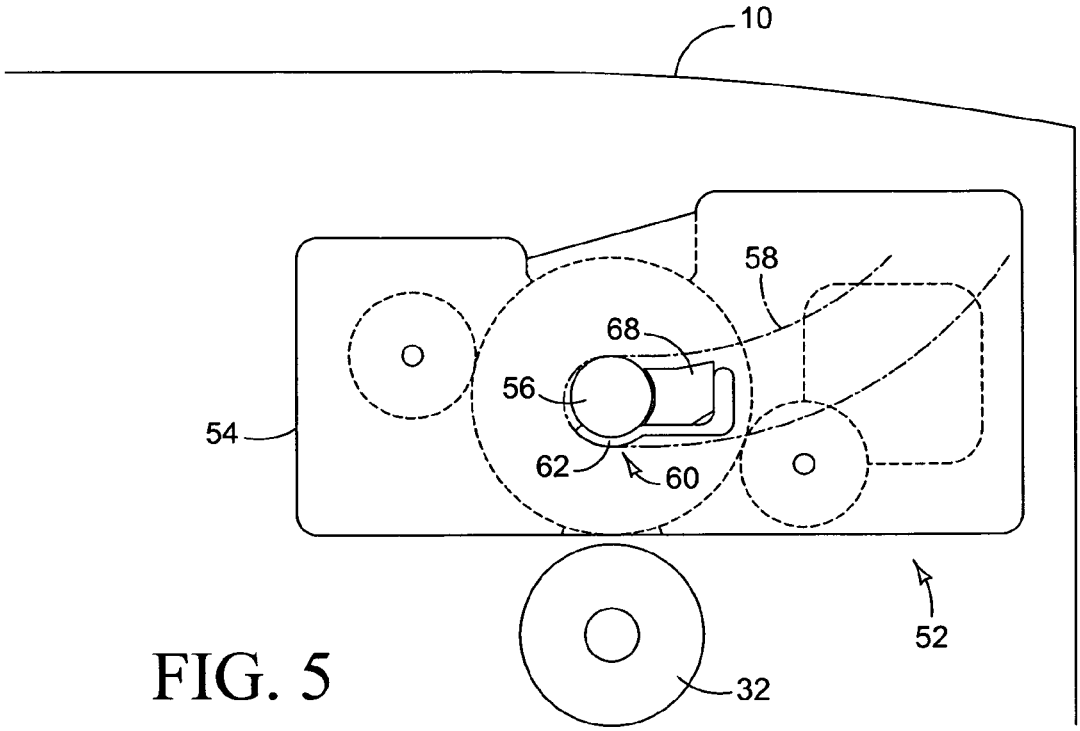
Figure 6:
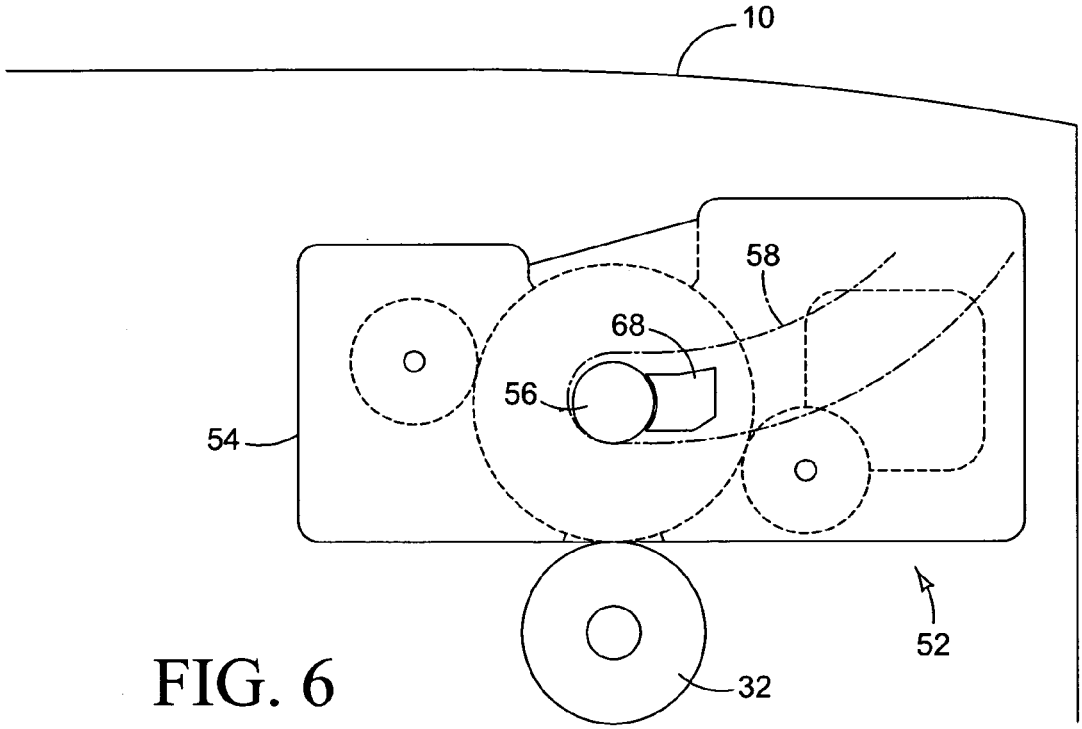

FIGS. 5 and 6 are side views illustrating a print cartridge such as the one shown in FIGS. 3 and 4 installed in a printer. FIG. 5 shows the print cartridge with packaging spacers. FIG. 6 shows the print cartridge without packaging spacers.

Figure 7:
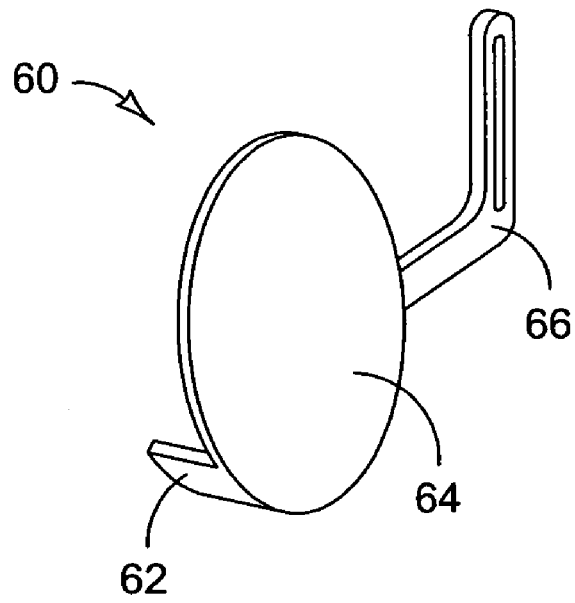
Figure 8:
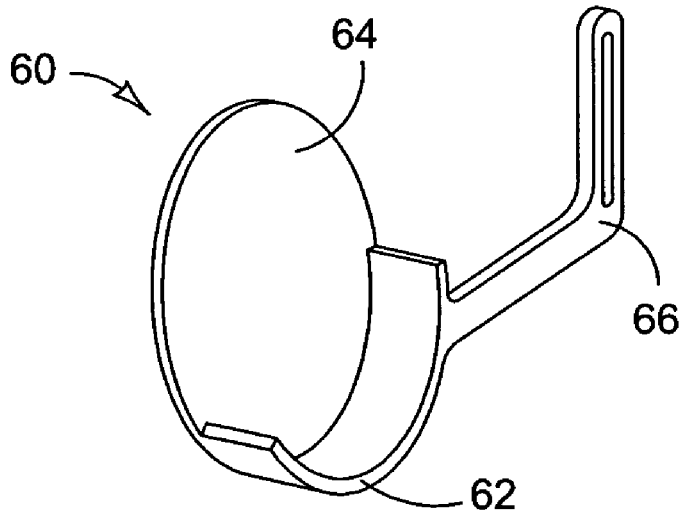

FIGS. 7 and 8 are detail perspective views illustrating a packaging spacer according to an embodiment of the invention.

Figure 9:
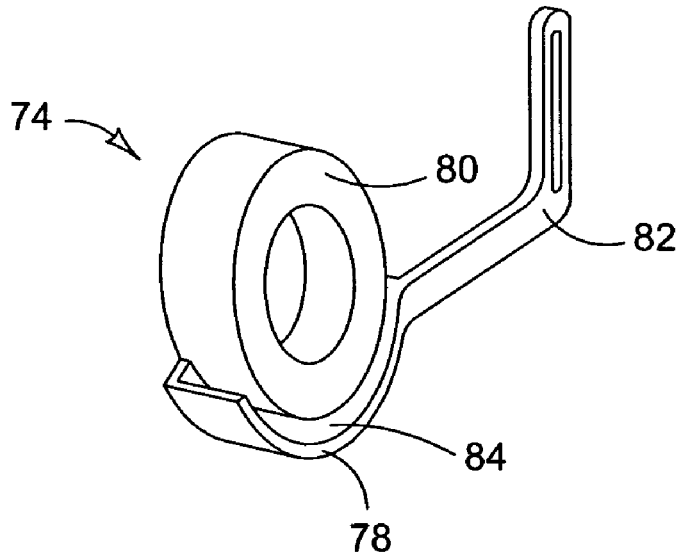
Figure 10:
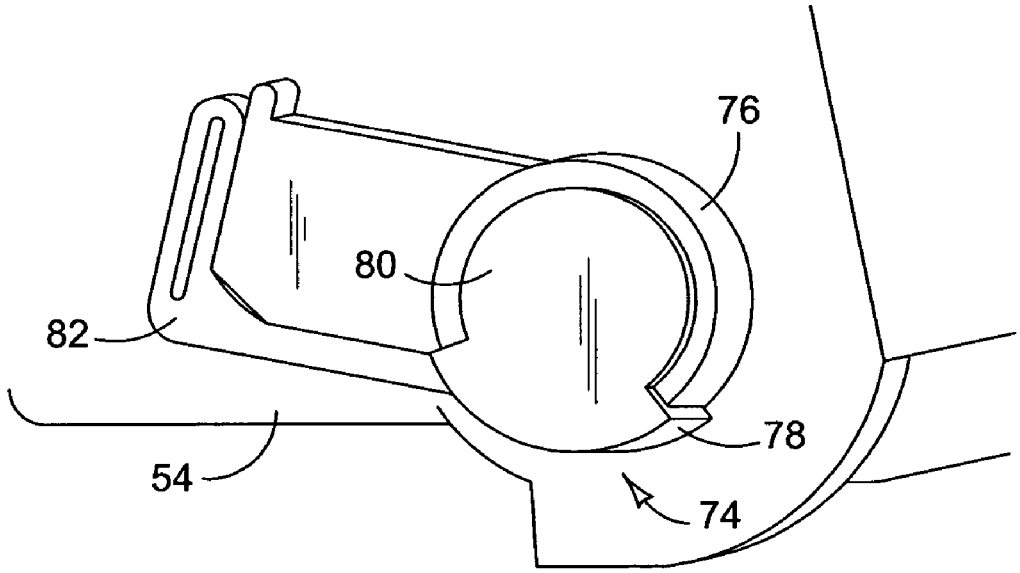

FIGS. 9 and 10 are perspective views illustrating another embodiment of a packaging spacer.

DESCRIPTION

Embodiments of the present invention were developed in an effort to separate the photoconductor drum from the transfer roller in a laser printer when the print cartridge is installed in the printer for packaging and shipping. Embodiments of a new spacer that may be used to separate the photoconductor drum from the transfer roller, therefore, will be described with reference to laser printing and print cartridges used in laser printers. Embodiments of the spacer, however, are not limited to use in laser printers. Rather, embodiments may be used in any application or environment which might benefit from such a spacer. The exemplary embodiments shown in the figures and described below illustrate but do not limit the invention. Other forms, details, and embodiments may be made and implemented. Hence, the following description should not be construed to limit the scope of the invention, which is defined in the claims that follow the description.

"Printer" as used in this document means any printing device and includes devices commonly referred to as copiers, printers, faxes and so-called "all-in-one" or "multifunction" devices.

Figure 1:
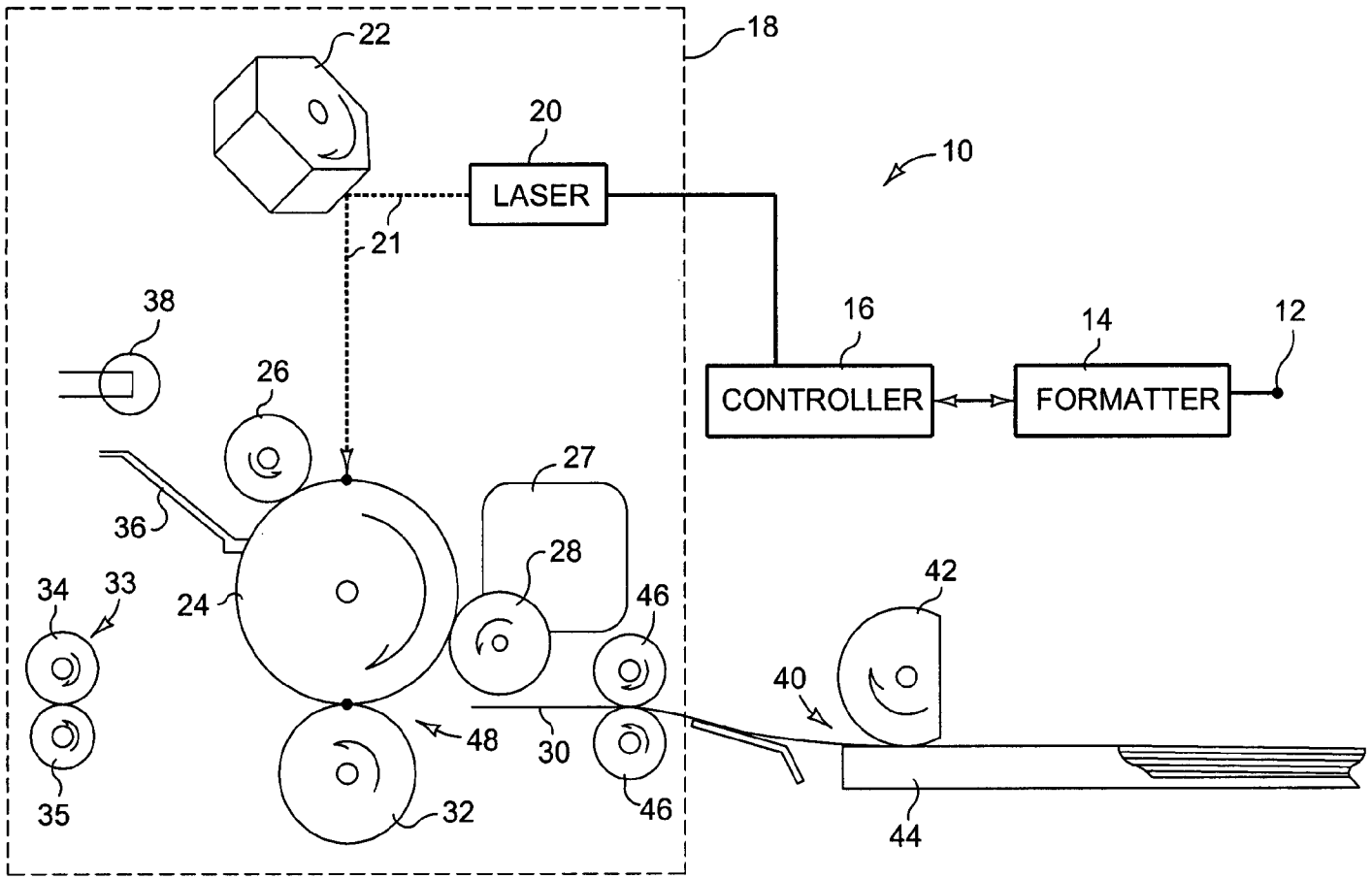
FIG. 1 is a schematic view illustrating the major components and operational characteristics of a laser printer.

In as much as the art of laser printing is well known, the basic components of one exemplary laser printer 10 in FIG. 1 are shown schematically and their operation described only briefly. In general, and referring to FIG. 1, document generating software on a personal computer, a scanner or some other input device transmits data representing the desired print image to input 12 on printer 10. This data is analyzed in formatter 14. Formatter 14 typically consists of a microprocessor and related programmable memory. Formatter 14 formulates and stores an electronic representation of each page to be printed. Once a page has been formatted, the data representing each page is sent to a printer controller 16. Controller 16, which also includes a microprocessor and related programmable memory, directs and manages the operation of print engine 18. Formatter 14 and controller 16 are often integrated together as a single processor/memory component of printer 10. The page data is used by controller 16 to modulate the light beam produced by laser 20 such that the beam of light 21 "carries" the data. The light beam 21 is reflected off a multifaceted spinning mirror 22. As each facet of mirror 22 spins through light beam 21, it reflects or "scans" the beam across the surface of photoconductive drum 24 to reproduce the page on the drum 24.

Charging roller 26 charges photoconductive drum 24 to a relatively high substantially uniform polarity at its surface. The areas of drum 24 exposed to light beam 21 are discharged. The unexposed background areas of drum 24 remain fully charged. This process creates a latent electrostatic image on conductive drum 24. Toner is electrostatically transferred from toner reservoir 27 by developing roller 28 onto photoconductive drum 24 according to the data previously recorded on the drum. The toner is thereafter transferred from photoconductive drum 24 onto paper or other media sheet 30 as sheet 30 passes between drum 24 and transfer roller 32. The toner is fused to the sheet at fuser 33. Fuser 33 includes fuser rollers 34 and 35 that apply heat and pressure to each sheet as it passes between the rollers. Drum 24 is cleaned of excess toner with cleaning blade 36, completely discharged by discharge lamp 38 and then recharged by charging roller 26.

Figure 2:
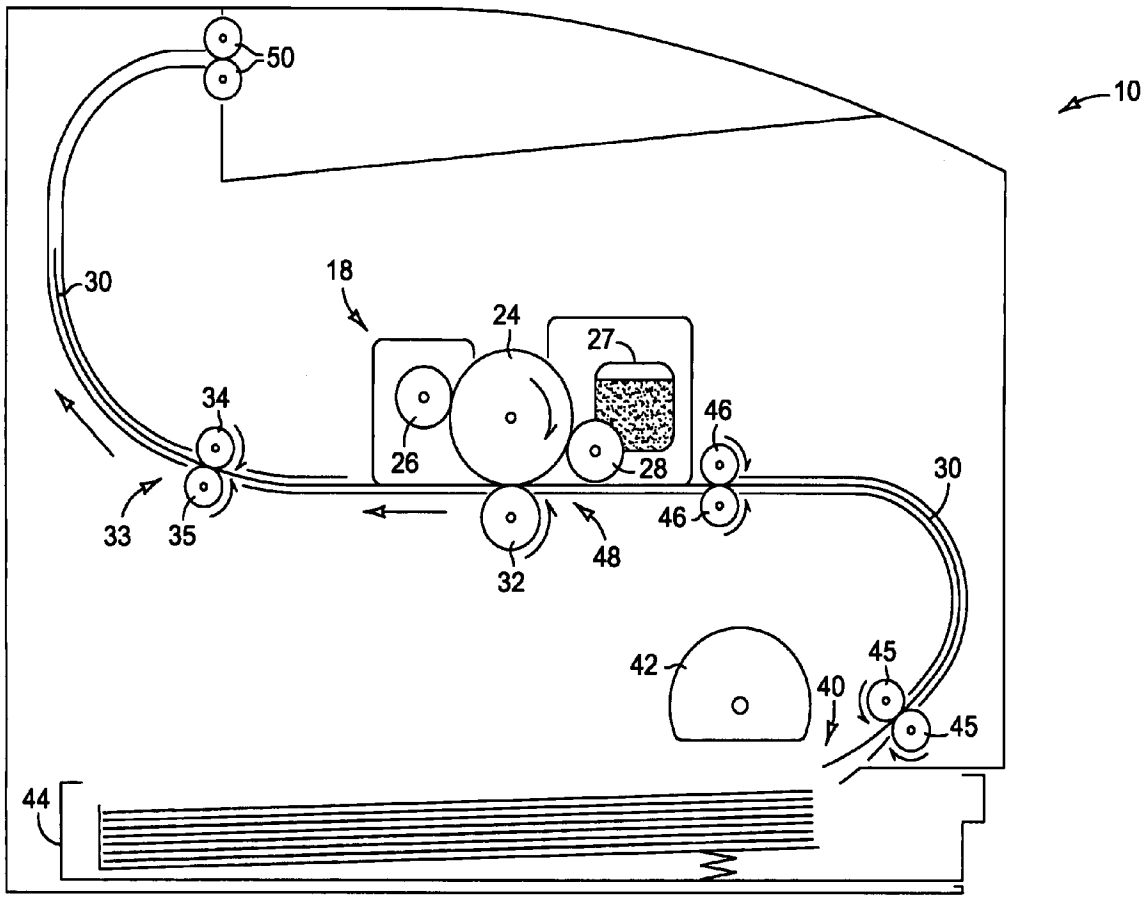
FIG. 2 is a side view illustrating a laser printer such as the one shown in FIG. 1.

FIG. 2 is a side view illustrating a laser printer such as printer 10 shown in FIG. 1. Referring now also to FIG. 2, each media sheet 30 is pulled into the pick/feed area 40 by feed roller 42 from a media tray 44. As the leading edge of sheet 30 moves through pick/feed area 40, it is engaged by transport rollers 45 which advance sheet 30 to registration rollers 46. Registration rollers 46 advance sheet 30 to image area 48 until it is engaged by drum 24 and transfer roller 32 and toner is applied as described above. Media sheet 30 advances to fuser 33 and on to output rollers 50.

Photoconductor drum 24, charging roller 26, toner reservoir 27 and developer roller 28 are housed in a removable print cartridge 52. One such print cartridge 52 is illustrated in FIGS. 3 and 4. FIGS. 5 and 6 are side views illustrating a print cartridge such as print cartridge 52 installed in a printer 10. FIG. 5 shows the print cartridge with a packaging spacer. FIG. 6 shows the print cartridge without a packaging spacer. Referring to FIGS. 3–6, cartridge 52 includes a housing 54 that supports photoconductor drum 24 at each end so that drum 24 can rotate within housing 54. One end of drum 24 (not shown) exposed through an opening in housing 54 is typically fitted with a gear or other driven mechanism that can engage a gear or other driving mechanism when cartridge 52 is installed in printer 10.

Projections 56 are formed on each end of housing 54 to guide cartridge 52 into the correct position in printer 10. In the embodiment shown in FIGS. 4–6, projections 56 are round pins that project out from cartridge housing 54 at each end of photoconductor drum 24. Guide pins 56 ride in a slot 58 (FIGS. 5–6) in the printer chassis or printer housing to guide cartridge 52 into the correct position in printer 10, as shown in FIGS. 5 and 6. Although pins in slots are commonly used in laser printers to correctly position the print cartridge in the printer, other positioning structures may be used.

Referring now also FIGS. 7–8, a removable spacer structure 60 fits on to projections 56. Spacer structure 60 includes a spacer 62, a cap 64 and an L shaped arm 66 that extends out from spacer 62. Each spacer 62 fits around the bottom of a guide pin 56 to raise photoconductor drum 24 up out of contact with transfer roller 32, as best seen by comparing FIGS. 5 and 6. Cap 64 and arm 66 are optional parts configured to help hold spacer 62 in the correct position on pin 56. The housing 54 of the print cartridge 52 shown in FIGS. 3 and 4 includes a rectangular projection 68 adjacent to each guide pin 56. An L shaped arm 66 conforming to a portion of the perimeter of projection 68, therefore, can be used to help position spacer 62 along the bottom of guide pin 56. In the embodiment shown, arm 66 also may be used to remove spacer structure 60. The tag end 70 of a toner dam 72 is slipped through a slot in arm 66 when spacer structure 60 is snapped in to place on guide pin 56. Spacer structure 60 pops off guide pin 56 when a user pulls on end 70 to peel toner dam 72 out of cartridge 52. Utilizing a packaging spacer on the print cartridge, such as spacer 62 in FIGS. 3–7, means the user can remove the spacer without reaching into the printer. When the user first unpacks the printer and removes the print cartridge; the spacers come out with the cartridge into plain view for easy removal. Coloring the spacers differently from the housing of the print cartridge also helps ensure easy removal for the user.

In the embodiment shown, spacer 62 forms a portion of a truncated ring to effectively increase the diameter of the lower part of a round guide pin 56. In general, the spacer is configured to increase the lower dimension of the projecting guide structure on the print cartridge enough to raise the photoconductor off the transfer roller. Any suitable removable fastener may be used to hold the spacer in place on the guide structure. For example, in the embodiment shown, a slight interference fit between spacer structure 60 and pin 56/projection 68 along the length of spacer 62 and arm 66 allows spacer structure 60 to snap into position over pin 56. Other suitable fasteners include a releasable adhesive or small clips that clasp on to the guide pin (or on to the spacer structure if the clips are formed on the guide pin).

FIGS. 9 and 10 show a spacer structure 74 configured for use on an annular guide 76. Annular guide 76 surrounds an opening in housing 54 that exposes the gear or other driven mechanism on the end of photoconductor drum 24. Spacer structure 74 includes a spacer 78, an annular cap 80 and an L shaped arm 82. Annular cap 80 fits into the opening in housing 54 and over the gear. Spacer 78 fits around the bottom of guide 76 to raise photoconductor drum 24 up out of contact with transfer roller 32 when print cartridge 52 is installed in printer 10. The truncated annular gap 84 fits over the lower part of guide 76. In the embodiment shown in FIGS. 9 and 10, spacer 78 forms a truncated ring to effectively increase the thickness of the lower part of an annular guide 76. Cap 80 on spacer structure 74 (FIGS. 9 and 10) and cap 64 on spacer 60 (FIGS. 7 and 8) prevents the drive gear or other drive mechanism from engaging the driven gear or other driven mechanism in print cartridge 52. The caps, therefore, help ensure that photoconductor drum 24 cannot be driven in the event a user fails to remove the spacer structures prior to attempting to use the printer.

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. An article, comprising a spacer configured to increase a dimension of only a portion of a guide part on a print cartridge when the spacer is fastened to the guide part and a fastener allowing the spacer to be removably fastened to the guide part, and wherein the fastener comprises an interference fit between the spacer and the guide part.

2. The article of claim 1, wherein the guide part on the print cartridge is round and the spacer is configured to increase a diameter of a lower part of the round guide part when the spacer is fastened to the guide part.

3. The article of claim 2, wherein the spacer comprises a disk and a truncated ring extending around part of a perimeter of the disk.

4. The article of claim 3, wherein the truncated ring and the disk intersect one another at a right angle.

5. The article of claim 1, wherein the guide part on the print cartridge is annular and the spacer is configured to increase a thickness of only a lower part of the guide part when the spacer is fastened to the guide part.

6. An article, comprising a spacer configured to increase a dimension of only a portion of a guide part on a print cartridge when the spacer is fastened to the guide part and a fastener allowing the spacer to be removably fastened to the guide part, and wherein the fastener comprises a releasable adhesive applied to the spacer.

7. An article, comprising a spacer configured to increase a dimension of only a portion of a guide part on a print cartridge when the spacer is fastened to the guide part and a fastener allowing the spacer to be removably fastened to the guide part, wherein the guide part on the print cartridge is annular and the spacer is configured to increase a thickness of only a lower part of the guide part when the spacer is fastened to the guide part and wherein the spacer comprises a cylinder and a truncated ring conforming to and spaced apart from a perimeter of the cylinder.

8. A print cartridge, comprising:

a housing;

a printing component supported in the housing;

a round guide part on the housing;

a spacer removably fastened to the guide part, the spacer comprising a disk and a truncated ring extending around part of a perimeter of the disk; and an L shaped arm projecting from the truncated ring in a plane substantially parallel to a plane of the disk.

9. A print cartridge, comprising:

a housing;

a printing component supported in the housing;

an annular guide part on the housing;

a spacer removably fastened to the guide part, the spacer comprising a cylinder and a truncated ring conforming to and spaced apart from a perimeter of the cylinder.

10. A print cartridge, comprising:

a housing;

a printing component supported in the housing;

a first round guide part on the housing;

a second annular guide part on the housing;

a first spacer removably fastened to the first guide part, the first spacer comprising a disk and a truncated ring extending around part of a perimeter of the disk; and a second spacer removably fastened to the second guide part, the second spacer comprising a cylinder and a truncated ring conforming to and spaced apart from a perimeter of the cylinder.

11. A print cartridge, comprising:

a housing;

an elongated photoconductor supported at each end in the housing;

a first male part on one end of the housing adjacent to a first support of one end of the photoconductor and a second male part on another end of the housing adjacent to a second support of another end of the photoconductor, each male part configured to seat in a mating female part on a printer to position the photoconductor against a roller when the print cartridge is installed in a printer; and a removable spacer placed on and conforming to a portion of a perimeter of each male part such that the photoconductor is spaced apart from the roller when the print cartridge is installed in the printer with the spacers in place on the male parts.

12. The cartridge of claim 11, wherein each removable spacer comprises a removable spacer placed on and conforming to a lower perimeter of each male part such that the photoconductor is raised off the roller when the print cartridge is installed in the printer with the spacers in place on the male parts.

13. The cartridge of claim 11, wherein the elongated photoconductor comprises a cylindrical photoconductor.

* * * * *